US005492495A

United States Patent [19]

Ashley

[11] Patent Number: 5,492,495

[45] Date of Patent: Feb. 20, 1996

[54] CUSTOMIZED BUILDING SET

[76] Inventor: Belinda M. Ashley, 2736 N. Xenophon Ave., Tulsa, Okla. 74127

[21] Appl. No.: 391,921

[22] Filed: Feb. 21, 1995

[51] Int. Cl.[6] ..... A63H 33/08

[52] U.S. Cl. ..... 446/110; 446/102; 446/106; 446/476

[58] Field of Search ..... 446/102, 106, 446/117, 122, 127, 105, 110, 476, 489

[56] References Cited

U.S. PATENT DOCUMENTS

| | | | |
|---|---|---|---|
| 732,384 | 6/1903 | Thomsen | 446/110 |
| 1,287,771 | 12/1918 | Schmitt | 446/110 |
| 1,510,326 | 9/1924 | Locke | 446/106 |
| 1,521,420 | 12/1924 | Beebe | 446/476 |
| 1,867,374 | 7/1932 | Myers | 446/110 |
| 1,898,297 | 2/1933 | Fox | 446/127 |
| 2,062,735 | 12/1936 | Warren | 446/117 |
| 2,422,217 | 6/1947 | Barnes | 446/110 |
| 2,787,029 | 4/1957 | Johnson | 446/106 |
| 4,822,315 | 4/1989 | Ben-Gal | 446/102 |

FOREIGN PATENT DOCUMENTS

| | | | |
|---|---|---|---|
| 595505 | 12/1947 | United Kingdom | 446/127 |

*Primary Examiner*—Robert A. Hafer
*Assistant Examiner*—Jeffrey D. Carlson

[57] ABSTRACT

A construction kit for toy building structures includes a plurality of basic planar logs having a slightly rounded edge on the lower face and male couplings on the lateral ends thereof. A plurality of alternative planar logs with a brick like patterned surface and male couplings on the lateral ends thereof are interchangeable with the above mentioned logs. The logs may be interconnected with angular connecting blocks having female receiving slots on four adjacent sides with a recessed area and a raised neck on opposing ends to accommodate adjoining blocks. The plurality of planar logs may be interconnected with architectural fixtures having receiving slots on the lateral edges. Recessed areas at angular points of the singular roof unit interconnects with the raised neck of the connecting blocks to form the skeletal structure. Raised receiving slots on opposing sides of the angular roof top and indentions along the roof line accommodate roof fixtures. A balcony is provided which telescopes to fit different house widths.

1 Claim, 6 Drawing Sheets

CUSTOMIZED BUILDING SET

BACKGROUND OF THE INVENTION

The invention relates to a construction set, and more particularly, toy building set having elements therein to build customized structures of selectable designs with interchangeable windows, doors, chimneys and roofs.

Various building sets are known in the art having basic log-like or block-like elements to construct various structures. As most sets enable the user to build basic structures, a novel element of such a set allows various novel functions to be incorporated in the building design.

The present invention introduces a novel building set which presents a plurality of elongated, planar building logs with a rounded lower face and male couplings at lateral ends thereof. The end of each log is defined by connectors. Each connector slides into a slotted receiving groove of the angular connector or into a slotted receiving groove of the angular connector or fixture. A plurality of alternative planar building logs with brick-like patterned anterior surfaces and couplings on the ends are interchangeable with the basic planar building log mentioned above.

The angular connector blocks have female receiving slots on four adjacent faces with a recessed area and a raised neck on opposing ends. The receiving slots accommodate the log connectors. The recessed area and elongated neck allow for interconnection with other blocks and fixtures.

The singular roof unit has recessed areas at angular points (corners) to provide juncture with the raised neck of the connecting blocks. On opposing sides of the angular roof top, there are raised receiving slots to accept male couplings of the roof top fixtures. Indentions along the anterior roof line accommodate roof fixtures that attach to the anterior portion of the structure.

Fixtures including doors and windows have receiving slots on the lateral surfaces to accommodate junction with the ends of the planar building logs. The detachable columned porch fixture has two protrusions from the posterior portion and dual columns from the anterior attaching to a base. The porch fixture slides into the grooved slots along the anterior roof line. The angular chimney has a flattened connector along the lower angled edge to interconnect with the raised receiving slot on the roof top.

The planar building logs may be interconnected with angular connecting blocks to form structures which include but are not limited to an angular deck, swimming arena, or animal enclosure.

It is therefore an object of this invention to provide a building set having interconnected planar logs, angular connecting blocks and fixtures therein.

It is another object of this invention to provide a building set, as aforesaid, having a plurality of planar logs which are interchangeable so as to provide generally planar wall surfaces.

A still further particular object of this invention is to provide a building set, as aforesaid, which allows for a slanted roof thereon.

It is another object of this invention to provide a building set which allows for an interchangeable relationship between planar logs, angular connecting block, and fixtures therein.

A further particular object of this invention is to provide a building set, as aforesaid, with planar logs capable of being mounted in an angular relationship therebetween.

A further object of this invention is to provide a building set, as aforesaid, having a plurality of planar logs of various lengths which are capable of being mounted to another angular connecting block or fixture therein.

A further object of this invention is to provide multilevel surfaces inside the structure with detachable floor units therein.

It is another object of this invention to provide a building set which allows the user access to the interior of the structure by removing one mounting wall therein.

Other objects and advantages of this invention will become apparent from the following description taken in connection with the accompanying drawings, wherein is set forth by way of illustration and example, an embodiment of this invention.

SUMMARY OF THE INVENTION

The customized building set introduces a novel design. The interchangeable elements easily attach and reattach to form new designs or modify existing ones. The building set structure accommodates designs with access to the interior structure.

The advantages and object of the customized building set is to allow the user to select and manipulate designs by including or excluding fixtures such as windows, doors, roofs, balconies, porches, chimneys or floors as desired. The elements are interchangeable, easily attach and detach, and offer versatility to open air designs. The doors and windows listed above can be moved up, down, left, or right by replacing planar logs of varying lengths.

The columned porch slides into a slot along the roof line to enhance the appearance of the exterior structure. The styling quickly changes from plain to formal in minutes by the addition.

The telescopically collapsible balcony slides to fit the desired width of the structure and stores easily in a compact unit. The connectors on the balcony slide into the receiving slots of the connecting blocks and the hinged stabilizing bar pulls down and rests against the side of the structure. The balcony adds additional floor space to the exterior or interior of the building.

The reversible floor unit has connectors at its angular points. These connectors slide into the receiving slots of the connecting blocks on the interior of the structure. The floor can be used in either direction. Each side has a different design and pattern. The floor unit offers the user multilevel floor space.

The roof fits neatly on top of the raised neck of the receiving blocks. Chimneys can be added to the roof top using raised preplaced receiving slots as desired.

As illustrated, the planar logs and connecting blocks can be interconnected to form structures including but not limited to the following: swimming pools, playpens, animal enclosures or saunas.

The advantages and objects of the improved building set design will become easy to see from the following brief description of the drawings and understood when read in connection with detailed description of the drawings.

DESCRIPTION OF THE PREFERRED EMBODIMENT

Figure 1:
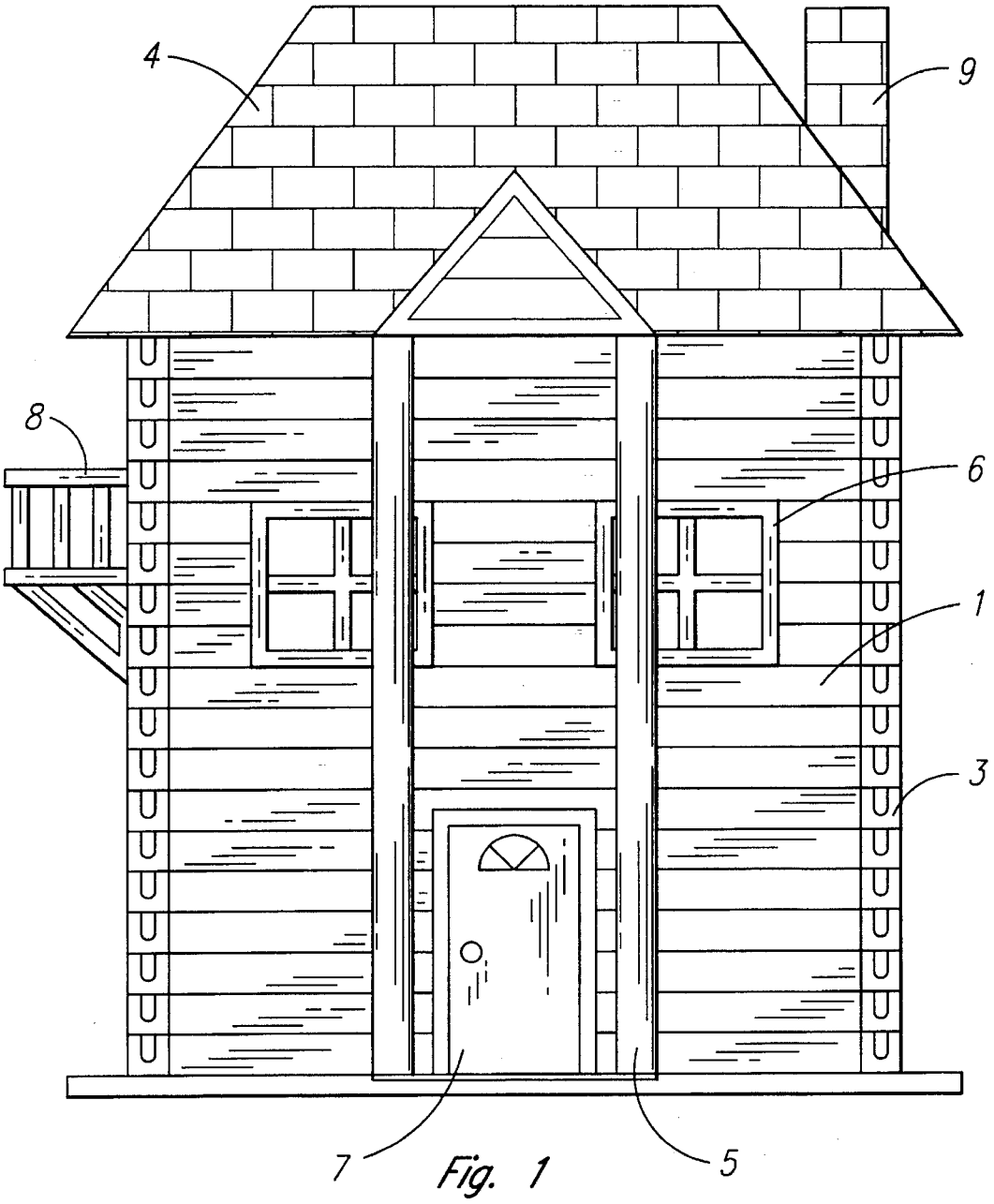
FIG. 1 is a perspective view of one building structure with a singular roof unit thereon, as constructed by utilizing the elements of the building set.

Turning more particularly to the drawings, FIG. 1 illustrates one building design utilizing the basic elements of the building set. As such the set comprises a plurality of elongated building logs of varying lengths either directly connected to the angular connecting blocks shown in FIG. 8 or to the lateral ends of the fixtures shown in FIGS. 17, 18, 19, and 20, forming a releasable positive connection. The placement of fixtures including doors and windows can be manipulated by adding or replacing varying lengths of elongated building logs. An alternative planar building log with a brick-like patterned anterior face shown in FIG. 7 can be used to replace or compliment the basic elongated planar logs shown in FIG. 4.

Figure 4:
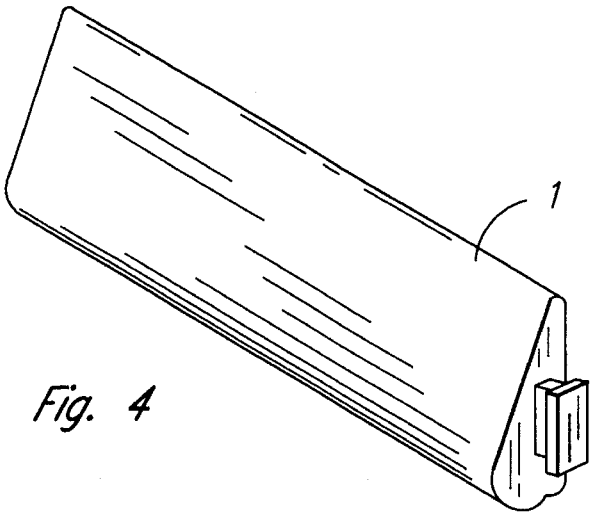
FIG. 4 is the front view of the basic planar wall slat in two contrasting lengths.
Figure 8:
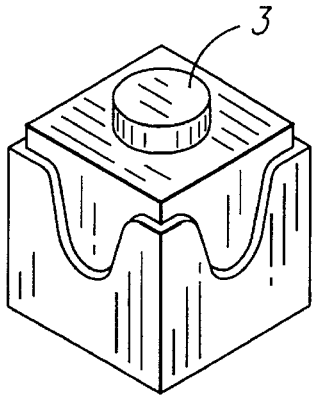
FIG. 8 is an elevated side view of the connecting block.
Figure 13:
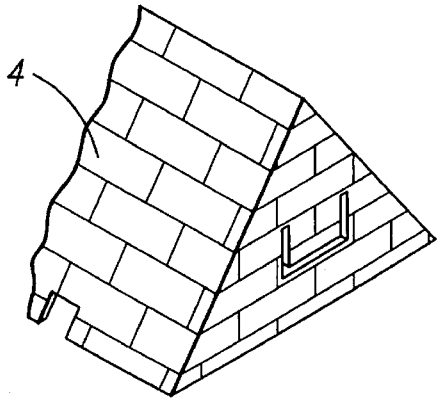
FIG. 13 is a side view of FIG. 11 showing the receiving slot for FIG. 10.
Figure 14:
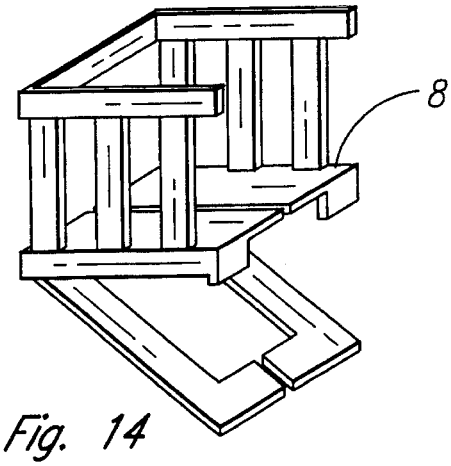
FIG. 14 is the side view of the collapsible balcony unit.
Figure 21:
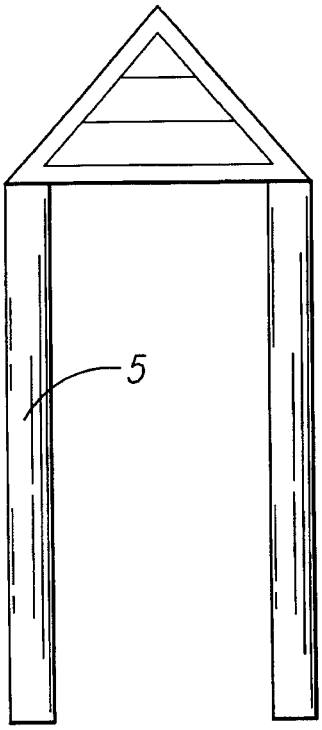
FIG. 21 is the anterior view of the columned porch.

The adjustable balcony shown in FIG. 14 can be raised or lowered on any exterior surface by interconnecting the male couplings on the lateral surfaces of the balcony with the receiving slots of the connecting blocks shown in FIG. 8. The columned porch slides into the grooves along the roof line as shown in FIGS. 4 and 21. The singular roof unit shown in FIGS. 11, 12 and 13 interlocks with the raised neck of the connecting blocks forming the skeletal structure. The chimney shown in FIGS. 9 and 10 slides into preplaced receiving slots on the roof top.

Figure 2:
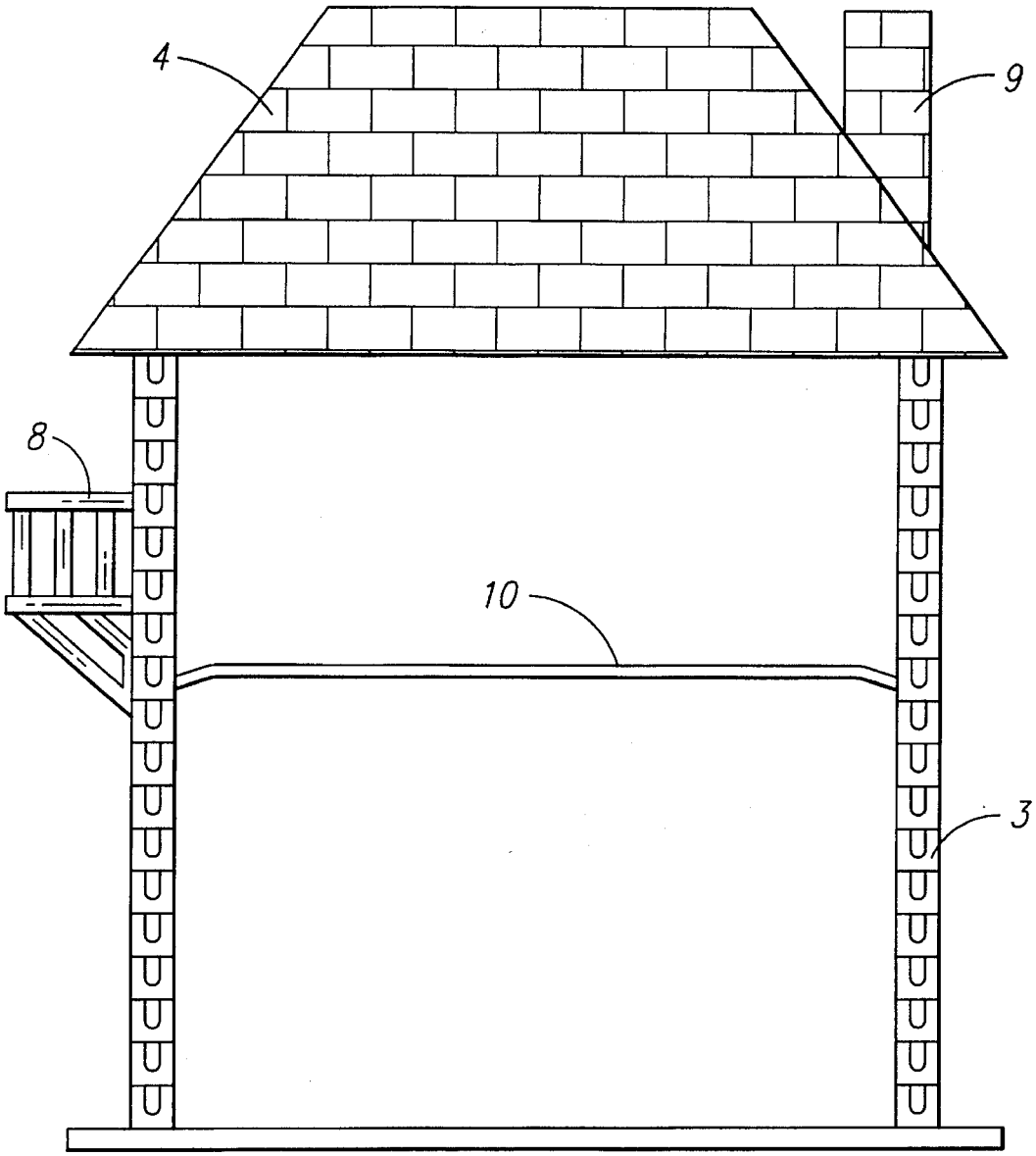
FIG. 2 is a posterior view of the structure shown in FIG. 1 with the adjustable floor unit interconnected.
Figure 10:
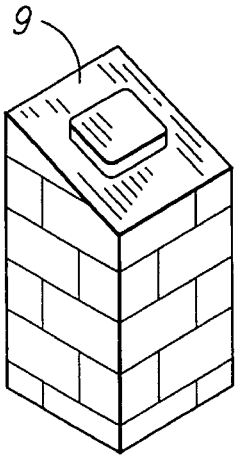
FIG. 10 is the side view of male coupling shown from underneath FIG. 9.
Figure 9:
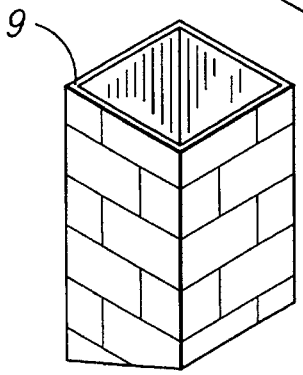
FIG. 9 is an elevated side view of the chimney.
Figure 15:
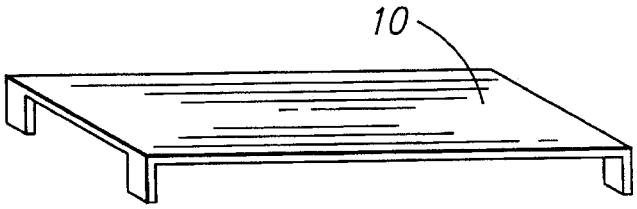
FIG. 15 is the floor unit with male couplings at the angular points to be interconnected with the connecting blocks.

FIG. 2 illustrates the posterior view of FIG. 1. The reversible floor unit shown in FIG. 15 is shown interconnected to the angular connecting blocks on the lateral edges of the structure. The roof unit shown in FIG. 11 rests atop the raised neck of the connecting blocks. The chimney shown in FIGS. 9 and 10 is shown interconnected with the roof top receiving slot.

Figure 3:
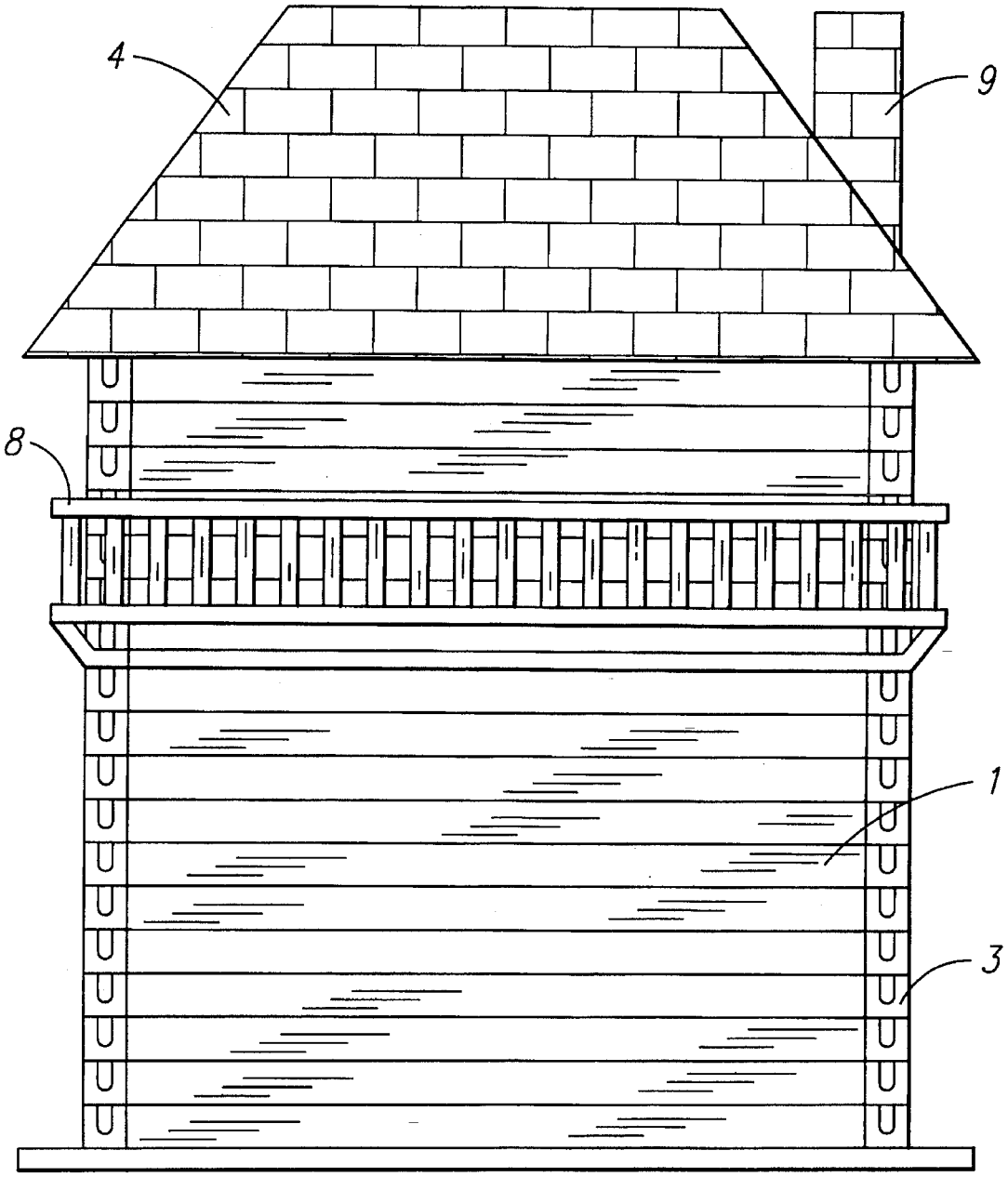
FIG. 3 is an elevated side view of the building shown in FIG. 1 with the collapsible balcony interconnected.

FIG. 3 shows the collapsible balcony as in FIG. 14 interconnected with the angular connecting blocks and the lowered stabilizing bar resting against the side of the structure.

Figure 5:
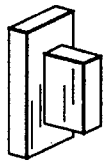
FIG. 5 is an enlarged side view of the connectors on the lateral sides of the wall slats in FIG. 4.
Figure 6:
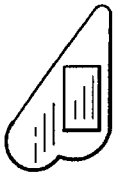
FIG. 6 is the side view of the wall slats shown in FIG. 4.

FIG. 4 shows two contrasting lengths of the basic elongated planar logs with a slightly rounded edge on the lower face and male couplings on the lateral ends thereof. FIG. 4 is also identified as number 1. The male couplings shown enlarged in FIG. 5 connect directly into the connecting blocks or the slots on the lateral edges of the doors and windows shown in FIGS. 18 and 20. FIG. 6 illustrates a side view of the elongated planar logs shown in FIG. 4.

Figure 7:
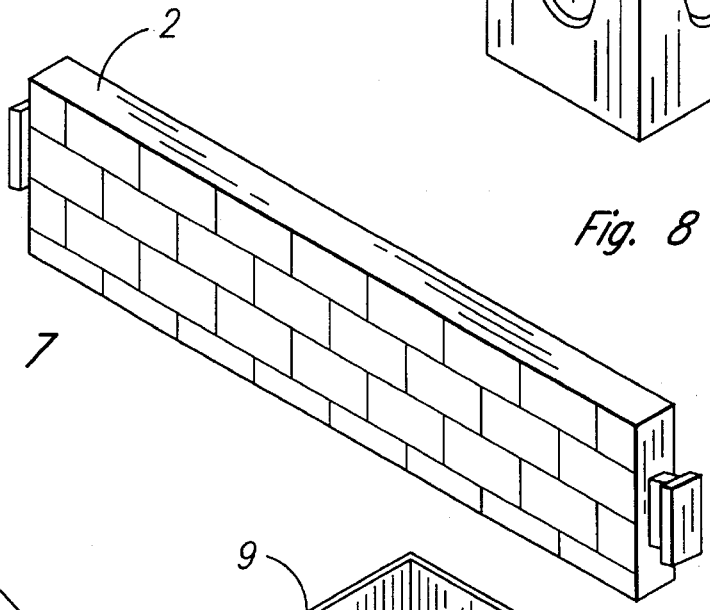
FIG. 7 is the front view of the alternative planar wall slat with a brick like pattern on the anterior face.

FIG. 7 is the alternative planar wall slat with the brick like patterned anterior face and also identified as element 2. This planar log is interchangeable with the basic planar log shown in FIG. 4. FIG. 7 can be used to construct a structure with a brick like appearance or in conjunction with the basic planar log.

FIG. 8 is the angular connecting block having female receiving slots on four adjacent sides with a recessed area and a raised neck on opposing ends to accommodate adjoining blocks. FIG. 8 is also identified as element 3. The connectors on the planar logs or fixtures slide neatly into the female receiving slots of the connecting blocks. The recessed end of the connecting block accept the raised necks of adjacent connecting blocks. The raised neck of the connecting blocks slide into recessed areas of other connecting blocks or accommodates the recessed areas of the roof fixture shown in FIGS. 11, 12 and 13.

FIG. 9 is the detachable chimney labeled element number 9. The male coupling shown in FIG. 10 is found underneath FIG. 9. The detachable chimney slides into the preplanned receiving slots on the roof unit shown in FIG. 13.

Figure 11:
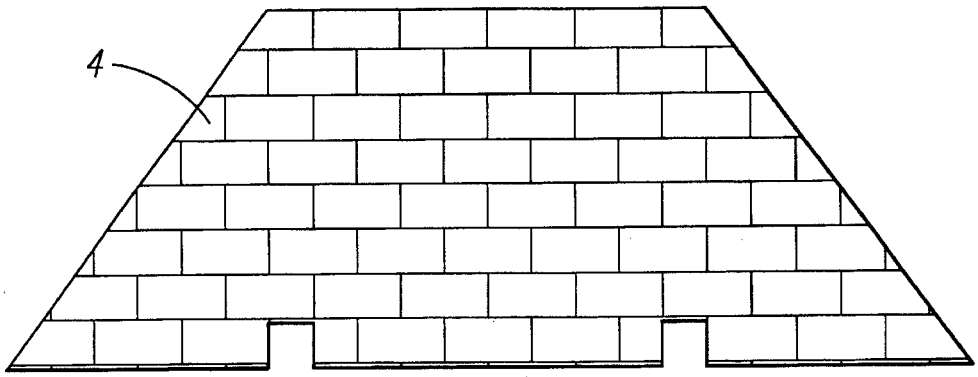
FIG. 11 is the side view of the singular roof unit.
Figure 12:
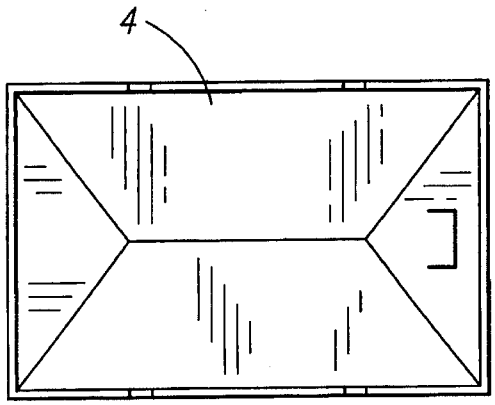
FIG. 12 is a view of FIG. 11 from underneath.

FIG. 11 is the singular roof unit with recessed areas at the angular points to accommodate the raised necks of the connecting blocks. The roof is identified as element 4. The roof line has grooves along the roof line to accept elongated attachments of the porch fixture. FIG. 12 is FIG. 11 shown from underneath. Also illustrated, FIG. 13 shows a closer view of the raised preplaced receiving slots for roof top fixtures.

FIG. 14 is the collapsible balcony unit. The balcony is also identified as element number 8. The balcony telescopically slides into guides along the base, railing, and stabilizing bar to increase and/or decrease the length of the balcony unit to accommodate the width of the structure. The balcony stores in a compact unit as shown in FIG. 14.

FIG. 15 is the reversible floor unit with male couplings at the angular points to be interconnected with the connecting blocks. The floor unit labeled element number 10 is reversible. Each side has contrasting colors and patterns. FIG. 15 provides multilevel floor space when attached to the angular connecting blocks on the interior of the structure. When combined with angular connecting blocks on the exterior of structure, other structures can be constructed including but not limited to the following: sun deck, raised floor, observation station or raised platform.

Figure 16:
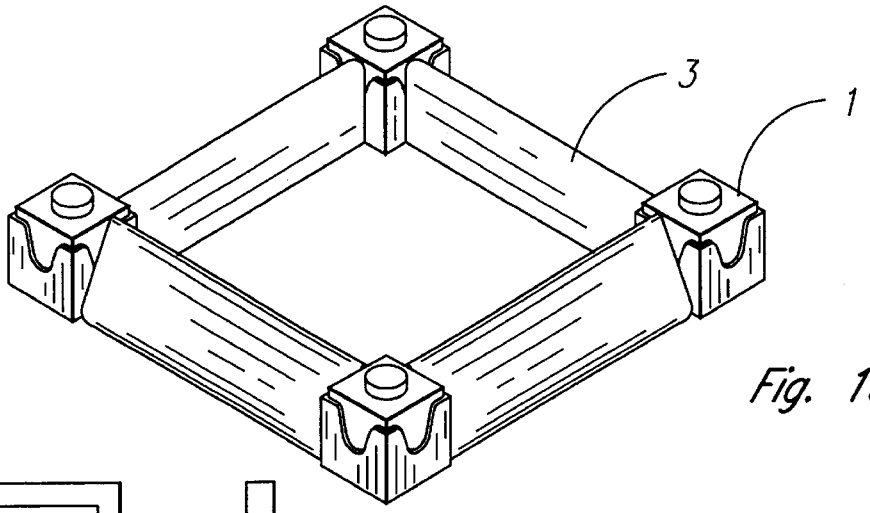
FIG. 16 is a perspective view of a structure utilizing alternative wall slats and connecting blocks shown in FIGS. 7 and 8.

FIG. 16 is a perspective view of an animal enclosure utilizing alternative wall slats and connecting blocks shown in FIGS. 7 and 8.

Figure 17:
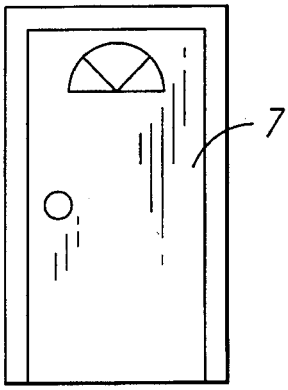
FIG. 17 is the anterior view of the door.
Figure 18:
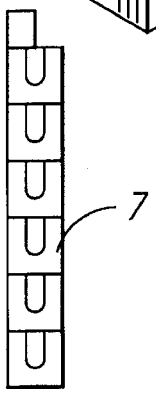
FIG. 18 is the side view of door shown in FIG. 17.

FIG. 17 is an anterior view of a door labeled element number 7. The side view of the door is shown in FIG. 18.

The planar wall slats interconnect with the lateral receiving slots along the edges of the door. FIG. 17 can be moved left and right by varying the lengths of planar logs used.

Figure 19:
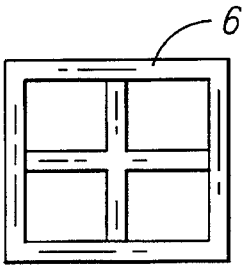
FIG. 19 is the front view of the window.
Figure 20:
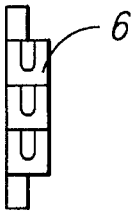
FIG. 20 is the side view of window unit shown in FIG. 19.

FIG. 19 is the front view of the window. FIG. 20 identified as element number 6 is the side view of the door shown in FIG. 19. The windows have receiving slots along its lateral edges which can be interconnected with the planar wall slats.

FIG. 21 is the columned porch fixture. The porch has elongated prongs that slide into slotted grooves along the roof line of FIG. 11. This attachment enhances the style of the structure.

Figure 22:
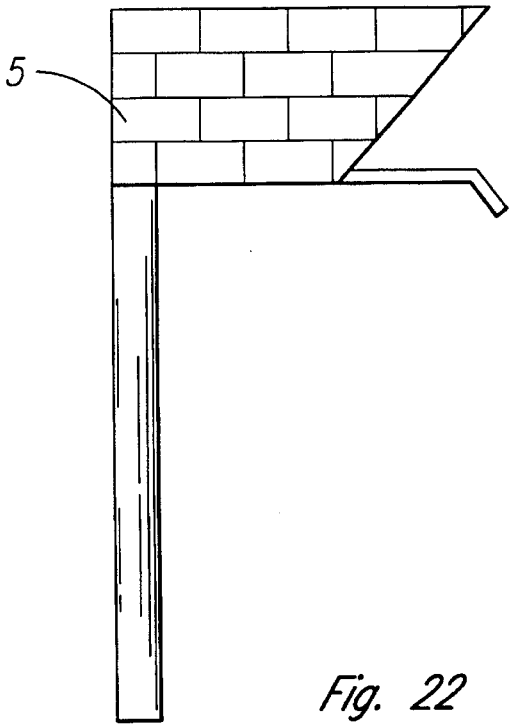
FIG. 22 is the side view of the columned porch shown in FIG. 21.

FIG. 22 is the side view of FIG. 21. The porch is identified as element number 5.

I claim:

1. A customized building set comprising:

a plurality of elongated planar wall slats each having a length and two opposite ends with male connectors at each end thereof, at least some of said slats provided with a brick patterned exterior and at least some of said slats being of different lengths;

a plurality of connecting blocks, each block having four adjacent sides and a top surface and a bottom surface, each side of said blocks having a female receiving slot sized and shaped complimentary to said male connectors to enable a removable positive connection between said blocks and said slats; each of said plurality of blocks further having a raised neck on the top surface and a recess on the bottom surface sized and shaped complimentary to said raised neck to enable a positive stacking connection with another of said plurality of blocks;

a singular roof unit with corners, a bottom edge periphery and opposing exterior surfaces; said roof provided with raised chimney slots on said opposing exterior surfaces, receiving grooves along the bottom edge periphery and recesses at the corners of the roof unit sized and shaped to receive the raised necks of the connecting blocks;

a chimney with an angled male coupling on its lower edge sized and shaped complimentary to said chimney slots to enable a releasable positive connection therebetween;

a balcony unit comprising two portions, one portion telescopically received in the other portion; said balcony unit provided with a base, a railing and a stabilizing bar; said balcony unit further provided with male connectors sized and shaped complimentary to said connecting block slots to enable a releasable connection therebetween, whereby the balcony unit may be telescopically adjusted and connected to structures of various widths built with said building set;

a reversible flat rectangular base, each corner of said base provided with extending male connectors sized and shaped to fit into the recesses of said connecting blocks to enable a releasable connection therebetween; said base connectors extending in opposite directions above and below the plane of the base so that it may be used in either orientation;

a door unit with lateral opposite edges each provided with receiving slots sized and shaped complimentary to the male connectors on said wall slats to enable a releasable connection therebetween;

a singular window unit with lateral opposite edges each provided with receiving slots sized and shaped complimentary to the male connectors on said wall slats to enable a releasable connection therebetween;

a columned porch unit provided with elongated prongs sized to fit into said roof receiving grooves to enable a releasable connection therebetween;

whereby said connecting blocks may be stacked in columns and each block may be connected together by said slats; said balcony unit, window unit, columned porch unit, door unit, roof unit and chimney may also be used to enhance different structures built with the building set.

* * * * *